US005530538A

United States Patent [19]

Godlove

[11] Patent Number: 5,530,538

[45] Date of Patent: Jun. 25, 1996

[54] METHOD AND APPARATUS FOR LUBRICATING AN ELEMENT IN A PRINTING APPARATUS

[75] Inventor: Ronald E. Godlove, Bergen, N.Y.

[73] Assignee: Xerox Corporation, Stamford, Conn.

[21] Appl. No.: 176,269

[22] Filed: Dec. 30, 1993

[51] Int. Cl.[6] ..... G03G 21/00

[52] U.S. Cl. ..... 355/299; 355/296; 15/256.5

[58] Field of Search ..... 355/208, 296, 355/299, 269, 270, 246, 302, 303; 118/652; 15/1.51, 256.5, 256.51

[56] References Cited

U.S. PATENT DOCUMENTS

| | | | |
|---|---|---|---|
| 3,982,830 | 9/1976 | Daniels et al. | 355/246 |
| 4,398,820 | 8/1983 | Thayer | 355/302 |
| 4,432,631 | 2/1984 | Bacon et al. | 355/269 X |
| 4,469,435 | 9/1984 | Nosaki et al. | 355/303 |
| 5,231,456 | 7/1993 | Kikuchi et al. | 355/270 |

FOREIGN PATENT DOCUMENTS

| | | | |
|---|---|---|---|
| 58-76875 | 5/1983 | Japan | 355/299 |
| 61-223773 | 10/1986 | Japan | 355/299 |
| 1-142587 | 6/1989 | Japan | 355/208 |
| 3-58075 | 3/1991 | Japan | 355/299 |

*Primary Examiner*—Joan H. Pendegrass
*Attorney, Agent, or Firm*—Finnegan, Henderson, Farabow, Garrett & Dunner

[57] ABSTRACT

An electrostatic printer employing a cleaning blade that applies a pressure on a photoreceptor substrate. The printer charges the cleaning blade to attract residual toner, ensuring that at least a minimal amount of toner will remain in the vicinity of the blade-substrate interface to lubricate the blade-substrate interface.

5 Claims, 7 Drawing Sheets

METHOD AND APPARATUS FOR LUBRICATING AN ELEMENT IN A PRINTING APPARATUS

BACKGROUND OF THE INVENTION

1. Field of the Invention

The present invention relates to method and apparatus for cleaning a substrate in a printing apparatus, and, more particularly, to a method and apparatus for cleaning the substrate while lubricating an interface between a cleaning element and the substrate.

2. Discussion of the Related Art

A typical document copier includes an electrostatic printer with a belt having a photoconductive surface. To transfer an image onto a sheet of paper, the printer charges the belt to a uniform potential, and subsequently exposes the belt to a pattern of light corresponding to the image. Parts of the belt exposed to the light are discharged, resulting in an electrostatic latent image being formed on the belt. The portion of the belt having the electrostatic image then passes a development station that deposits toner on the belt in the pattern of the image, resulting in a toner powder image being formed on the belt. A piece of paper is then tacked to the belt and then removed from the belt, resulting in an image being formed on the paper.

In a printing process of this type, some residual toner particles will remain on the photoconductive surface after the toner image has been transferred to the paper. In addition to the residual toner, other residual particles, such as paper debris, additives and plastic, are left behind on the surface after image transfer. The residual particles should be mostly removed prior to the next printing cycle to avoid their interference with production of another image.

Various methods may be used for removing residual particles, such as methods employing a cleaning brush, a cleaning web, or a cleaning blade of a rubber-like material such as polyurethane. Blade cleaning scrapes or wipes across the belt to remove the residual particles from the belt. Blade cleaning is a desirable method for removing residual particles due to its simplicity and economy. Blade cleaning entails frictional contact with the belt, however, which degrades the blade over a period of time.

After the cleaning blade removes toner fixed to the belt, a system transports the toner from the cleaning blade to a receptacle. Because toner at the blade-belt interface acts as a lubricant, however, the conventional transport process can result in excessive friction at the interface, resulting from insufficient toner remaining in the vicinity of the interface.

The following disclosures may be relevant to various aspects of the present invention and may be briefly summarized as follows:

U.S. Pat. No. 3,918,809 to Hwa discloses an apparatus for cleaning liquid developer from an upwardly moving support surface, such as a reusable surface for carrying latent electrostatic images. Cleaning blades clean the support surface. Separate members hold the cleaning blades in contact with the support surface.

U.S. Pat. No. 5,034,774 to Higginson et al. discloses an apparatus for applying toner for developing an electrostatic latent image formed on the charge retaining surface of a moving recording medium. The apparatus includes compliant cleaning blades for contacting a drying roller to prevent agglomeration of paper fibers and toner particles on the interface between the roller and the scraper blade.

OBJECTS AND SUMMARY OF THE INVENTION

It is an object of the invention to provide a printing apparatus having an improved substrate cleaning system.

It is another object of the present invention to provide a printing apparatus that charges a cleaning member to attract a lubricant to the cleaning member.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, a method of operating an apparatus having a substrate and a cleaning member contacting the substrate, comprises the steps of moving the substrate relative to the cleaning member; depositing a charge of a first potential on the substrate; illuminating the substrate to selectively dissipate the charge on the substrate; and charging the cleaning member to a potential different from the first potential.

According to another aspect of the present invention, an apparatus comprises a substrate; a particle remover for removing particles having a first polarity from the substrate; means for moving the substrate relative to the particle remover; and means for applying a voltage, of a polarity opposite to the first polarity, to the particle remover.

According to another aspect of the present invention, a method of operating an apparatus, including a substrate and a particle remover for removing particles having a first polarity from the substrate, comprises the steps of moving the substrate relative to the particle remover; and applying a voltage, of a polarity opposite to the first polarity, to the particle remover.

According to yet another aspect of the present invention, an apparatus comprises a substrate having a substantially uniform surface portion and a nonuniform surface portion; a particle remover for removing particles from the substrate; means for moving the substrate relative to the particle remover; and means for selectively supplying a voltage to the particle remover when the nonuniform surface portion of the substrate passes the particle remover.

According to yet another aspect of the present invention, a method of operating an apparatus, including a substrate having a substantially uniform surface portion, a nonuniform surface portion, and a particle remover for removing particles from the substrate, comprises the steps of moving the substrate relative to the particle remover; and selectively applying a voltage to the particle remover when the nonuniform surface portion of the substrate passes the particle remover.

BRIEF DESCRIPTION OF THE DRAWINGS

The accompanying drawings, which are incorporated in and which constitute a part of this specification, illustrate one embodiment of the invention and, together with the description, explain the principles of the invention. In the drawings.

DESCRIPTION OF THE PREFERRED EMBODIMENTS

Figure 1:
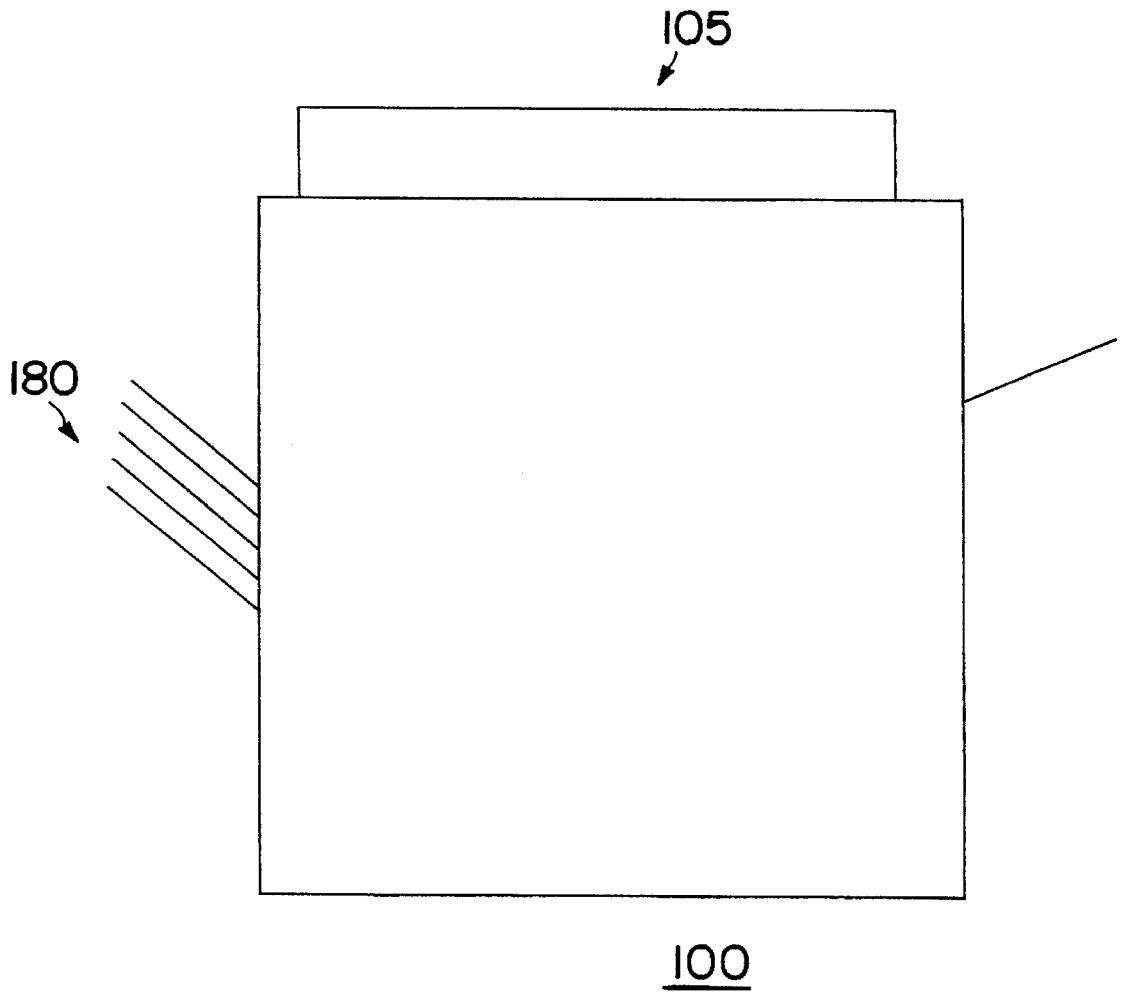
FIG. 1 is a side view of a copier according to the preferred embodiments of the present invention.

In FIG. 1, a preferred copier 100, including an electrostatic printer, of the preferred embodiments of the present invention is shown to include a document feeder 105 for transporting an original document to a platen where the copier scans the original document. Copier 100 then duplicates the original document image onto a sheet of paper and transports the sheet of paper to paper output tray 180.

Figure 2:
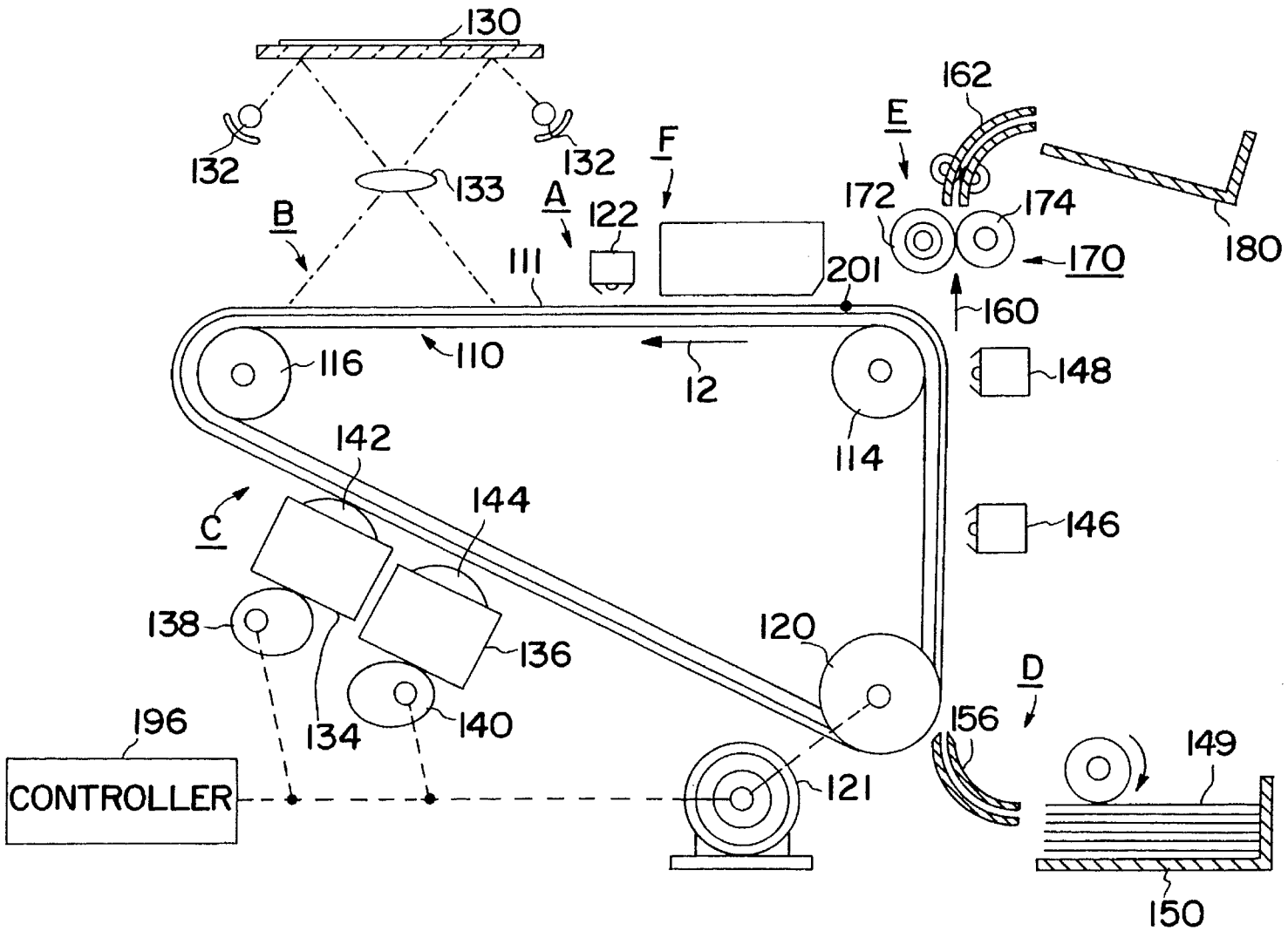
FIG. 2 is a schematic elevational view depicting various operating components of the copier shown in FIG. 1.

The interior of the copier 100, as shown in FIG. 2, includes a substrate or photoreceptor belt 110 having a photoconductive surface 111. Belt 110 moves in the direction of arrow 12 to advance successive portions of belt 110 through various processing stations sequentially disposed about the path of movement of belt 110. Belt 110 is entrained about a stripping roller 114, a tension roller 116, and a drive roller 120 driven by a motor 121. A pair of springs (not shown) maintain belt 110 in tension by resiliently urging tension roller 116 against belt 110. Both stripping roller 114 and tension roller 116 are rotatably mounted.

Belt 110 has a substantially uniform surface portion and a non-uniform surface portion or seam 201.

Seam 201 represents a welding seam of belt 110. Because welding seam 201 is a non-uniformity on belt 110, areas of belt 110 in the vicinity of seam 201 are not used in the imaging process.

Initially, a portion of belt 110 passes through charging station A, where a corona device 122 charges a portion of belt 110 to a relatively high, substantially uniform, potential, either positive or negative.

At exposure station B, flash lamps 132 illuminate an original document on transparent platen 130. Lens 130 projects light rays reflected from the original document onto the charged portion of belt 110 to selectively dissipate the charge on surface 111. This selective discharging records an electrostatic latent image, corresponding to an image of the original document, on belt 110. Alternatively, a laser may be provided to selectively discharge belt surface 111 in accordance with stored electronic information.

Belt 110 then advances the electrostatic latent image to development station C. Development station C includes two developer housings 134 and 136 for developing the electrostatic latent image on belt 110. Cams 138 and 140 move housings 134 and 136 into and out of developing positions. Motor 121 selectively drives cams 138 and 140. Each developer housing 134 and 136 supports a developing system including brush rolls 142 and 144, each of which includes a rotating magnetic member for advancing developer mix, carrier beads and toner, into contact with the electrostatic latent image. The electrostatic latent image attracts toner particles from the carrier beads to form a toner powder image on belt 110. If only one color of developer material is required, the second developer housing may be omitted.

A sheet of paper 149 advances from supply tray 150 to transfer station D through chute 156. Belt 110 advances the toner powder image to transfer station D, where the sheet of paper contacts the powder image on belt 110. A corona generator 146 charges the paper to a potential such that the paper becomes tacked to belt 110, and the toner powder image is attracted from belt 110 to the paper. A corona generator 148 then charges the paper such that the paper becomes detached from belt 110, allowing stripping roller 114 to remove the paper from belt 110.

Subsequently, the paper moves in the direction of arrow 160 to fusing station E. Fusing station E includes a fuser assembly 170 that permanently affixes the transferred toner powder image to the paper. The copy paper sheets pass through the nip of a heated fuser roller 172 and a backup roller 174 to fix the toner powder image to the copy paper sheets. The copy paper sheets then advance through a chute 162 to paper output tray 180.

Figure 3:
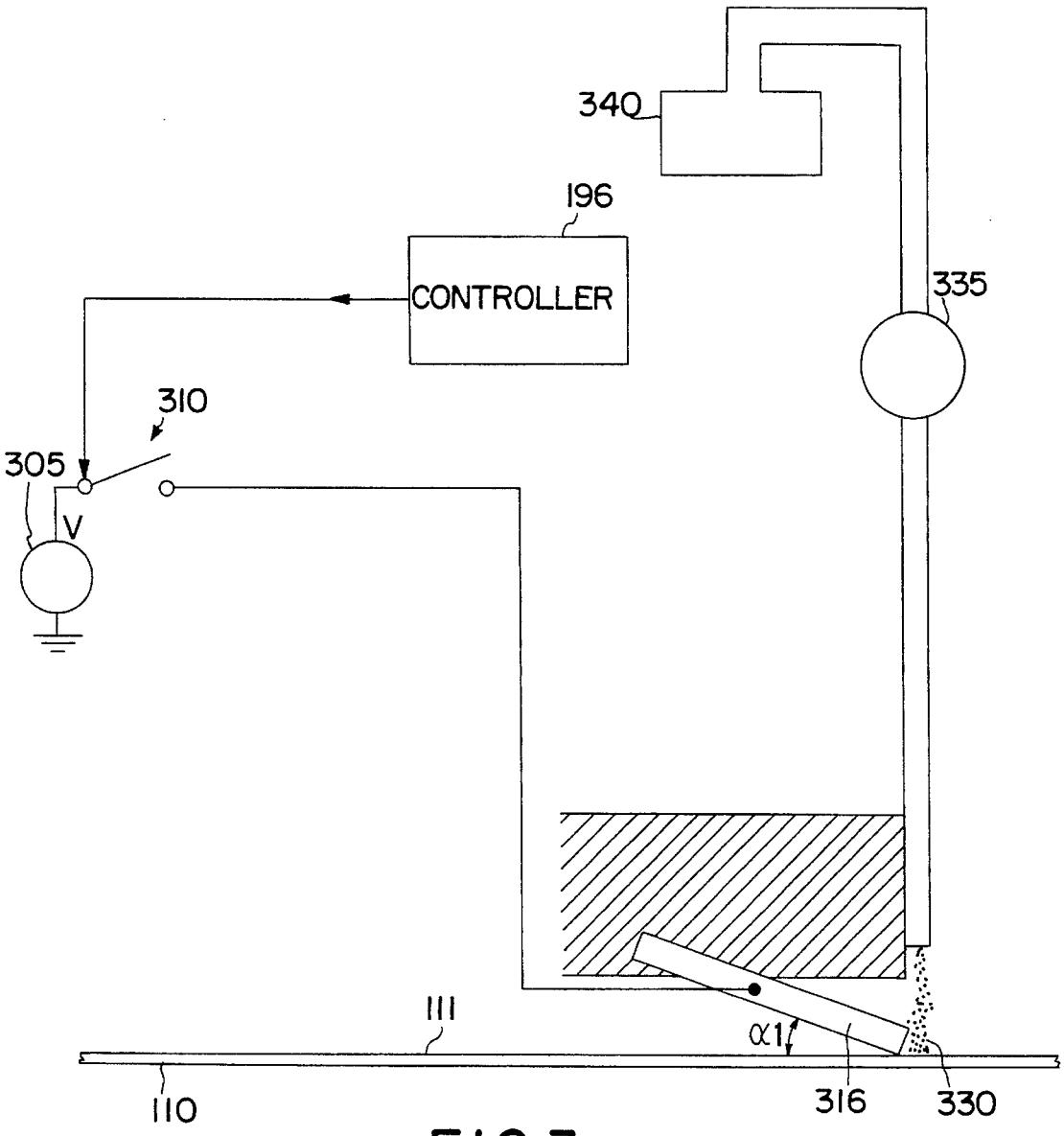
FIG. 3 is a schematic view of one of the operating components of the copier shown in FIG. 2, in accordance with a first embodiment of the present invention.

Cleaning station F removes residual particles remaining on photoreceptor belt 110 after each copy is made. FIG. 3 shows cleaning station F in more detail. Cleaning blade 316 removes most of the residual particles from the surface of belt 111. A vacuum system, including vacuum pump 335, transports the removed particles to a particle receptacle 340.

Cleaning blade 316 is composed of a conductive material.

Voltage generator 305 applies a voltage of a polarity opposite to that of the removed toner, to maintain a reserve of toner 330 in the vicinity of cleaning blade 316. This reserve of toner 330 acts to lubricate the interface between cleaning blade 316 and belt 110.

Voltage source 305 applies the voltage to cleaning blade 316 through switch 310. Controller 196 closes switch 310 when non-imaging areas of belt 110 are in contact with cleaning blade 316. Controller 196 opens switch 310 when imaging areas of belt 110 are in contact with cleaning blade 316, to ensure that imaging areas of belt 110 are not damaged by current flow between cleaning blade 316 and belt 110.

Figure 4:
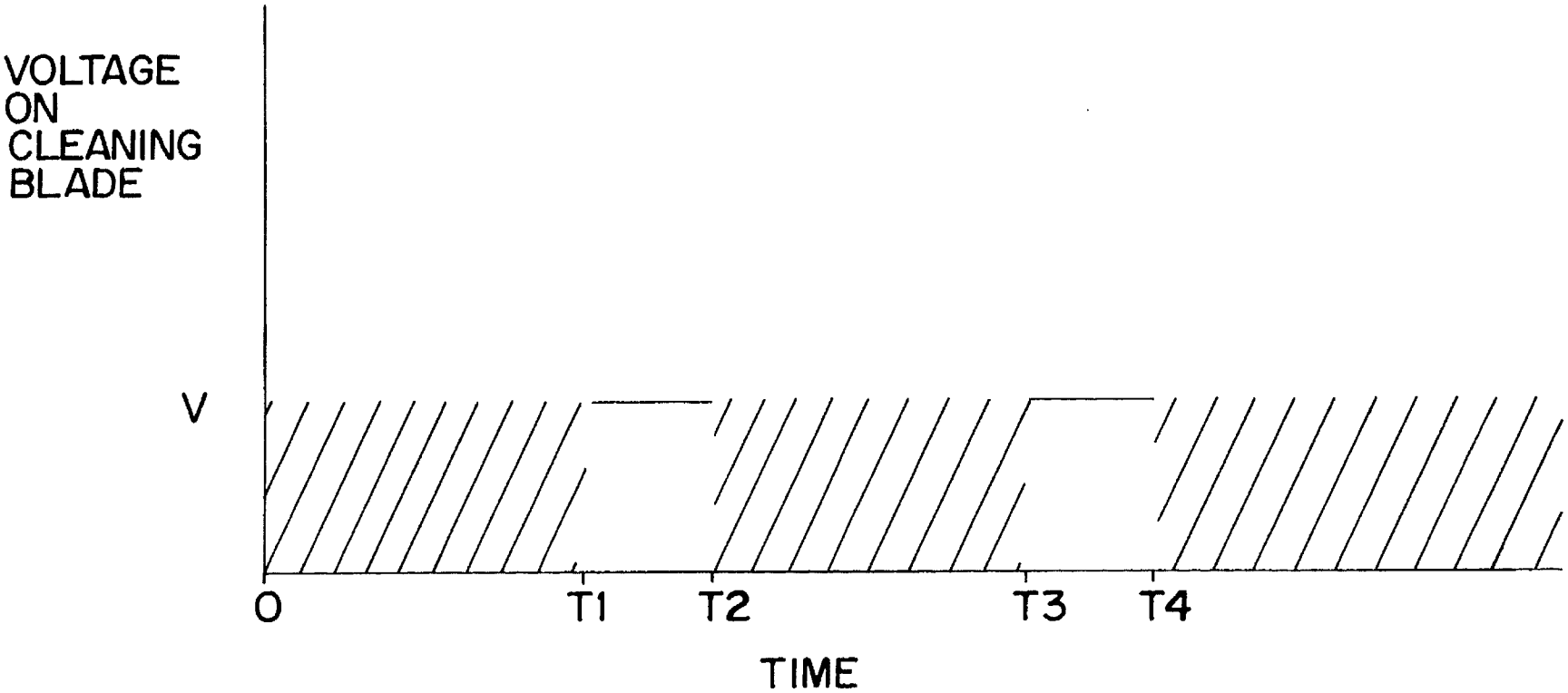
FIG. 4 is a timing diagram illustrating an operation of the operating component shown in FIG. 3.

FIG. 4 shows the operation of switch 310. The time between 0 and T1 on the horizontal axis represents a time when an imaging area of belt 110 is in contact with cleaning blade 316, and switch 310 is, therefore, open, resulting in cleaning blade 316 being electrically isolated from voltage source 305, as represented by hatched lines in FIG. 4. Between T1 and T2, a non-imaging area of belt 110 is in contact with cleaning blade 316. Thus, controller 196 closes switch 310 to charge cleaning blade 316 to a voltage V, the voltage of voltage source 305. Similarly, switch 310 is open during the interval between T2 and T3, because an imaging area of belt 110 is again in contact with cleaning blade 316, and switch 310 is closed during the interval between T3 and T4 because a non-imaging area of belt 110 is in contact with cleaning blade 316.

The non-imaging area of belt 110 includes seam 201.

Thus, controller 196, switch 310, and voltage source 305 act to charge cleaning blade 316 in synchronism with the movement of seam 201. A result of this synchronism is that the period of the cycle of switch 310 is the same as the period of the revolution of belt 110. If there were more than one non-imaging area on belt 110, controller 196 could close switch 310 for each non-imaging area, resulting in the period of the cycle of switch 310 being an integer multiple of the period of belt 110.

Figure 5:
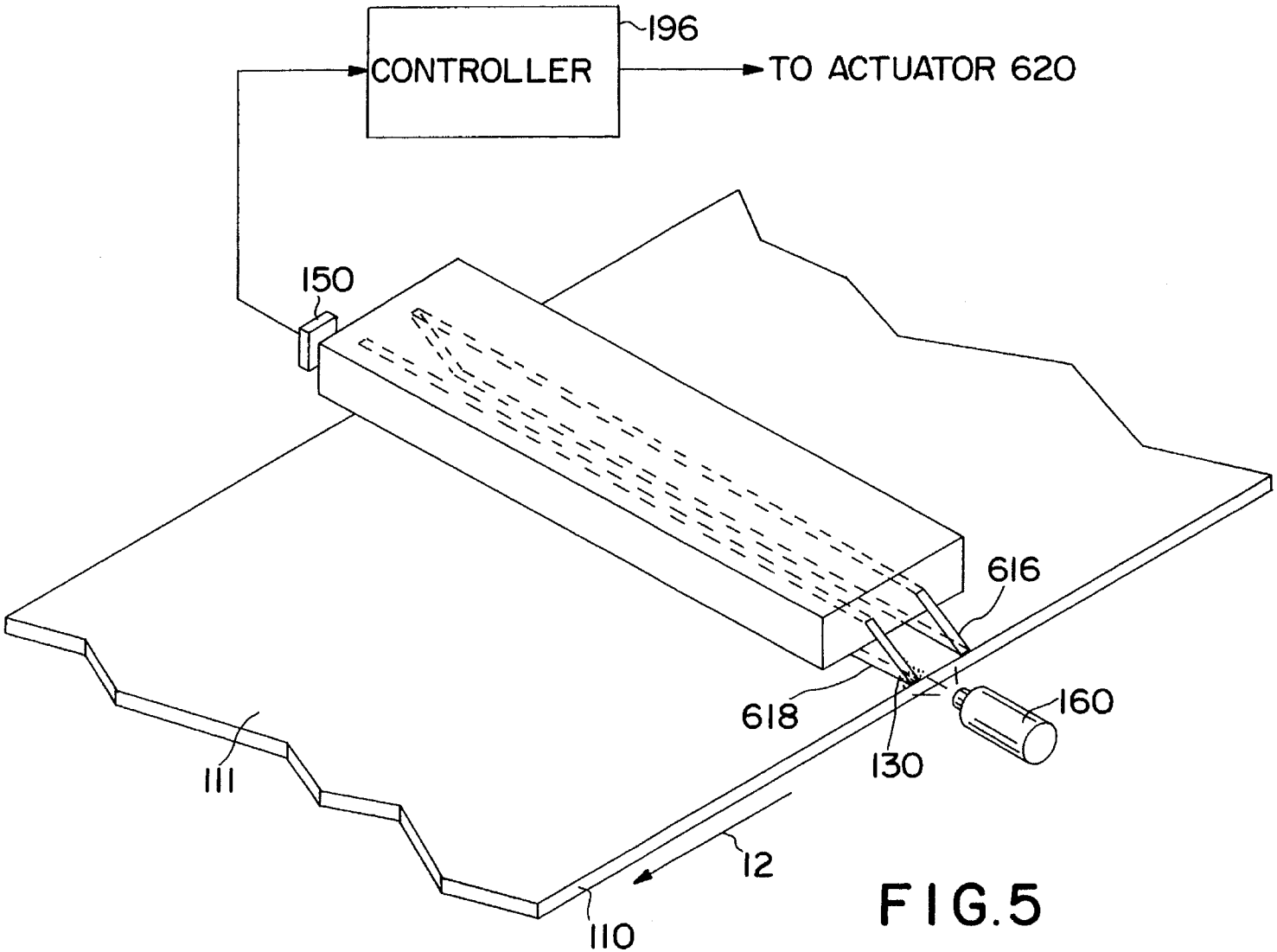
FIG. 5 is a partially schematic, fragmentary perspective view showing a portion of the operating component of FIG. 2 in more detail, in accordance with a second embodiment of the present invention.
Figure 6:
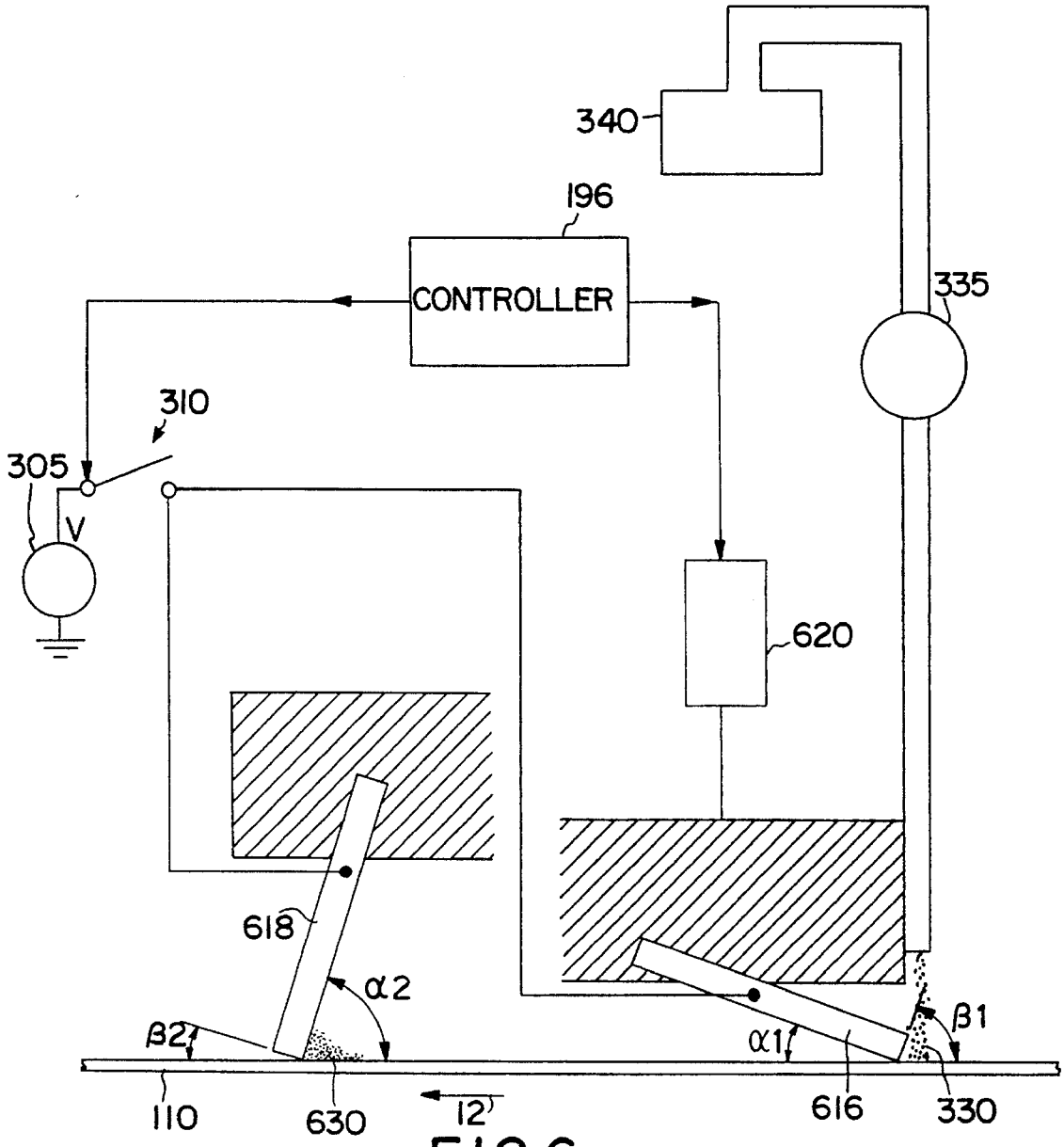
FIG. 6 is a diagramatic cross-sectional view showing a portion of the operating component of FIG. 2 in more detail, in accordance with the second embodiment of the present invention.

FIGS. 5 and 6 show cleaning station F in more detail, in accordance with a second embodiment of the present invention. In FIGS. 5 and 6, elements corresponding to elements in FIG. 3 are designated with corresponding reference numbers.

A primary cleaning blade 616 is located upstream in the process direction from a secondary cleaning blade 618. Primary blade 616 removes most of the residual particles from the surface of belt 110. Secondary blade 618 accumulates particles not removed by primary blade 616. A photodetector 150 and light source 160 oppose each other upstream from the cleaning edge of secondary cleaning blade 618.

Secondary blade 618 accumulates particles in a location that blocks the optical path between light source 160 and photodetector 150, which then sends a signal to controller 196 to control actuator 620 to vary the amount of pressure applied to primary blade 616, as discussed in more detail below.

FIG. 6 shows a cross-section of cleaning blades 616 and 618, each having an edge in frictional contact with the surface of belt 110 at an angle $\alpha$ (where $\alpha=180°-(\beta+90°)$). Primary blade 616 is configured in the "doctoring mode," having an angle $\alpha 1$ of approximately 10° to 25°, with a preferred angle of approximately 15° when the pressure on primary blade 616 is approximately 35 grams/cm.

Secondary blade 618 is configured in the "wiping mode," having an angle $\alpha 2$ of approximately 65° to 80° with a preferred angel $\alpha 2$ of approximately 75° when the pressure on secondary blade 618 is approximately 35 grams/cm. In general, the secondary blade pressure for a given angle $\alpha$ will be less than that of the primary blade loading, because toner securely fixed on belt 110, and therefore passing between the blade and belt 110, acts as a lubricant, and the secondary blade will see less of this securely fixed toner than the primary blade sees.

Secondary blade 618 accumulates residual particles 630 as copier 100 operates over a period of time. Copier 100 clears accumulated toner 130 by periodically blowing compressed air, by swabbing with a piece of plastic foam or other material, or, when copier 100 is not generating copy output, by momentarily camming secondary blade 618 away from belt 110, allowing the accumulated particles to be carried by belt 100 to the upstream primary blade 616.

In general, an excessively large amount of toner getting past primary blade 616 indicates that primary blade 616 should apply additional pressure to belt 110. The rate of toner pile growth 630 is an increasing function of the rate of toner getting past primary blade 616. The amount of light detected by detector 150 is a decreasing function of the size of toner pile 630. Thus, if the amount of light received by detector 150 is below a certain threshold, a certain amount of time after cleaning blade 618 has been cleared of toner, controller 196 causes actuator 620 to apply a greater amount of pressure to primary blade 616, resulting in primary blade 616's applying a greater amount of pressure to belt 110.

It is desirable to always have some small level of residual toner passing under primary blade 616 to provide lubrication. Thus, an excessively small amount of toner getting past primary blade 616 indicates that primary blade 616 can, or should, apply less pressure to belt 110. If the amount of light detected by detector 150 is above a certain threshold, a certain amount of time after cleaning blade 618 has been cleared of toner, controller 196 causes actuator 620 to apply a lesser amount of pressure to cleaning blade 616, resulting in cleaning blade 616's applying a lesser amount of pressure to belt 110. Thus, controller 196 controls actuator 620 to apply pressure as an increasing function of detected toner.

In the second preferred copier, controller 196 causes actuator 620 to adjust the pressure on blade 616 no more often than every few hours, since the particle detection feedback loop operates relatively slowly, as blade 618 normally accumulates toner relatively slowly.

Thus, the second preferred copier maintains the lubrication of primary blade 616 in two ways. First, it charges primary blade 616 so that at least a minimal amount of toner, removed from belt 110, will remain in the vicinity of primary blade 616, despite the action of vacuum pump 335. Second, it regulates the pressure on primary blade 616 so that a sufficient amount of toner will pass under primary blade 616.

Figure 7:
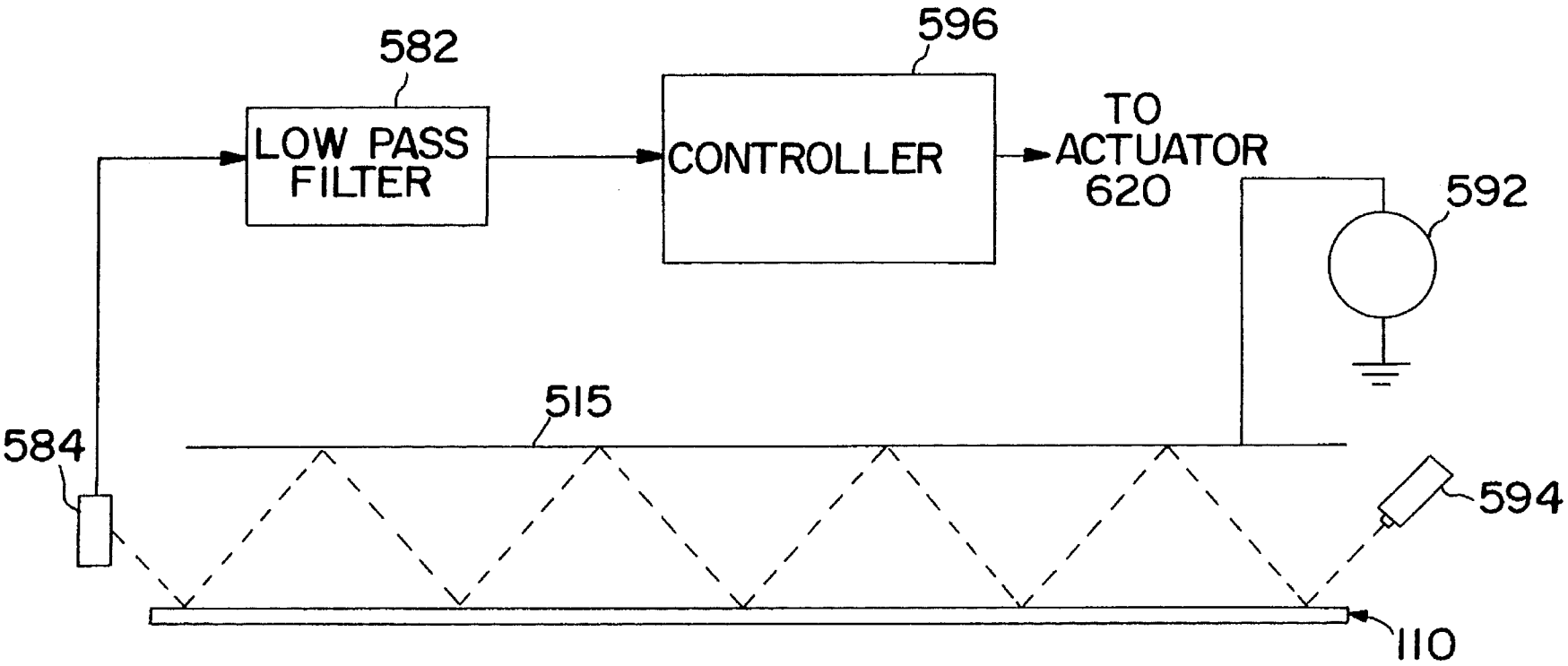
FIG. 7 is a cross-section of an alternative to some of the operating components shown in FIG. 5.

FIG. 7 shows an alternative to the toner detection system shown in FIG. 5. Laser 594 directs a light beam towards belt 110. If the light beam impinges on belt 110 on an area containing no residual particles, the light beam will be reflected to mirror 515, which is positioned approximately one inch above belt 110. Mirror 515 then reflects the light beam back to belt 110. Thus, the light beam reflects off of belt 110 multiple times before reaching detector 584.

If the light beam impinges on an area of belt 110 containing one or more residual particles, the amount of light received by detector 584 decreases.

Detector 584 sends a signal to low pass filter 582, which generates a smoothed version of the signal from detector 584, and sends the smoothed signal to controller 596. Low pass filter 582 compensates for the rapid movement of toner particles, fixed on moving belt 110, relative to laser 594 and detector 584. Controller 596 causes actuator 620 to apply pressure to blade 616 as a decreasing function of the smoothed signal from low pass filter 582.

Laser 594 is angled such that the light beam will impinge onto belt 110 a certain amount of times. A higher angle of incidence results in more reflections off belt 110 and a greater sensitivity of the system, resulting from an increased probability that the light beam will impinge on an area of belt 110 containing a toner particle. If the angle of incidence of a light beam is too high, however, the light signal ultimately received by detector 584 will be decreased, resulting from increased absorption by belt 110 due to the increased angle of incidence and resulting from the increased number of reflections from belt 110 and mirror 515 before the light beam ultimately impinges on detector 584.

Mirror 515 should be separated from belt 110 by a sufficient distance so that mirror 515 is not overly susceptible to contamination by toner particles. Further, to reduce toner particle contamination, bias voltage generator 592 charges mirror 515 with the same polarity as the toner particles to repel the toner particles. Further, air streams sweep across mirror 515, detector 584, and laser 594 to keep mirror 515, detector 584, and laser 594 relatively free of particles.

Although a vacuum system for transporting removed particles has been illustrated, the particles may be transported by an auger in front of the cleaning blade, or, if the cleaning station is located under the belt, the particles may be transported by gravity.

Although a switch for preventing a voltage from being constantly applied to the cleaning blade has been illustrated, in systems where the substrate would not be adversely affected by current flow between the cleaning blade and the substrate, no such switch is necessary and the voltage may be constantly applied to the cleaning blade.

A method of operating an apparatus having a substrate or belt 110 and a cleaning member or cleaning blade 316 contacting the belt 110 according to the present invention comprises the steps of: moving the belt 110 relative to the cleaning blade 316; depositing a charge of a first potential on the belt 110; illuminating the belt 110 to selectively dissipate the charge on the belt 110; and charging the cleaning blade 316 to a potential different from the first potential.

Thus, the preferred embodiments of the present invention employ a method for causing at least a minimal amount of toner to remain in proximity to the cleaning blade, to lubricate the blade-substrate interface.

Additional advantages and modifications will readily occur to those skilled in the art. The invention in its broader aspects is therefore not limited to the specific details, representative apparatus, and illustrative examples shown and described. Thus, various modifications and variations can be made to the present invention without departing from the scope or spirit of the invention, and it is intended that the present invention cover the modifications and variations provided they come within the scope of the appended claims and their equivalents.

I claim:

1. A method of operating an apparatus having a substrate, a cleaning member contacting the substrate, and a second member located downstream from the cleaning member for accumulating residual particles, the method comprising the steps of:

moving the substrate relative to the cleaning member;

depositing a charge of a first potential having a polarity on the substrate;

illuminating the substrate to selectively dissipate the charge on the substrate;

charging the cleaning member to a potential different from the first potential and to a polarity the same as that of the first potential; and charging the second member.

2. A method of operating an apparatus having a substrate and a cleaning member contacting the substrate, the method comprising the steps of:

moving the substrate relative to the cleaning member;

depositing a charge of a first potential having a polarity on the substrate;

illuminating the substrate to selectively dissipate the charge on the substrate;

charging the cleaning member to a potential different from the first potential and to a polarity the same as that of the first potential;

detecting residual particles at a location downstream from the cleaning member; and causing the cleaning member to apply a variable pressure to the substrate, the variable pressure being an increasing function of an amount of residual particles detected by the detecting step.

3. An apparatus comprising:

a substrate having a substantially uniform surface portion, and a nonuniform surface portion;

a particle remover for removing particles from the substrate;

means for moving the substrate relative to the particle remover; and means for selectively applying a voltage to the particle remover when the nonuniform surface portion of the substrate passes the particle remover.

4. A method of operating an apparatus including a substrate having a substantially uniform surface portion and a nonuniform surface portion, and a particle remover for removing particles from the substrate, the method comprising the steps of moving the substrate relative to the particle remover; and selectively applying a voltage to the particle remover when the nonuniform surface portion of the substrate passes the particle remover.

5. A method of operating an apparatus including a substrate having a substantially uniform portion and a nonuniform surface portion, and a particle remover having a conductive blade for removing particles from the substrate, the method comprising the steps of:

moving the substrate relative to the particle remover; and selectively applying a voltage to the conductive blade when the non-uniform surface portion of the substrate passes the particle remover.

* * * * *